United States Patent [19]

Wright

[11] Patent Number: 4,807,601

[45] Date of Patent: Feb. 28, 1989

[54] LIVE DISPLAY APPARTUS FOR SETTING EXTENSON AND FLEXION LIMITS IN CONTINUOUS PASSIVE MOTION (CPM) SYSTEM

[75] Inventor: Thomas C. Wright, New Brighton, Minn.

[73] Assignee: Empi, Inc., St. Paul, Minn.

[21] Appl. No.: 811,636

[22] Filed: Dec. 20, 1985

[51] Int. Cl.[4] ..... A61H 1/02

[52] U.S. Cl. ..... 128/25 R

[58] Field of Search ..... 128/25 B, 25 R

[56] References Cited

U.S. PATENT DOCUMENTS

| | | | |
|---|---|---|---|
| 4,323,060 | 4/1982 | Pecheux | 128/84 R |
| 4,492,222 | 1/1985 | Hajianpour | 128/25 B |
| 4,509,509 | 4/1985 | Bouvet et al. | 128/25 R |
| 4,520,827 | 6/1985 | Wright et al. | 128/423 W |
| 4,558,692 | 12/1985 | Greiner | 128/25 B |
| 4,566,440 | 1/1986 | Berner et al. | 128/25 R |
| 4,671,257 | 6/1987 | Kaiser et al. | 128/25 R |

*Primary Examiner*—Leo P. Picard

*Attorney, Agent, or Firm*—Kinney & Lange

[57] ABSTRACT

A live display apparatus for setting extension and flexion limits in a continuous passive motion (CPM) system. The CPM system includes a carriage for supporting a patient's limb through a range of reciprocal angular movement, a drive motor for driving the carriage, a carriage state sensor for providing a signal representative of carriage state and a control unit responsive to the carriage state sensor for controlling the drive motor. The live display apparatus includes an operator controlled extension limit select switch which is operatively coupled to the control unit. The select switch causes the carriage to be driven through its range of movement to a desired extension limit when actuated during an extension limit select mode. Data representative of the selected extension limit is stored in extension memory. An extension limit display is responsive to the control unit and provides a visual display indicative of the extension limit selected. An operator controlled flexion limit select switch is operatively coupled to the control unit, and causes the carriage to be driven through its range of movement to a desired flexion limit when actuated during a flexion limit select mode. Data representative of the selected flexion limit is stored in flexion memory. A flexion limit display provides a visual display indicative of the selected flexion limit.

22 Claims, 2 Drawing Sheets

FROM CONTROL UNIT 14
TO CONTROL UNIT 14

FROM CONTROL UNIT 14
TO CONTROL UNIT 14

LIVE DISPLAY APPARTUS FOR SETTING EXTENSON AND FLEXION LIMITS IN CONTINUOUS PASSIVE MOTION (CPM) SYSTEM

BACKGROUND OF THE INVENTION

1. Field of the Invention.

The invention relates to a continuous passive motion (CPM) system for mobilizing a joint of a patient's limb. In particular, the present invention is a live display apparatus for setting extension and flexion limits of movement in a CPM system.

2. Description of the Prior Art.

Continuous passive motion (CPM) therapy is becoming an increasingly popular form of orthopedic care following an injury, illness, or surgical procedure to a joint of a patient's limb. During CPM therapy an external force is applied to the limb so as to flex and extend the limb, thereby inducing motion of the joint. Continuous passive motion of a joint following injury, illness or surgery has been found to reduce post-operative pain, decrease adhesions, decrease muscle atrophy, and enhance the speed of recovery. These benefits are achieved while minimizing other risks of immobilization such as venus stasis, thromboembolism and post-traumatic osteopenia.

Devices for performing continuous passive motion are well known and disclosed, for example, in the Pecheaux U.S. Pat. No. 4,323,060 and Wright et al U.S. Pat. No. 4,520,827. When in operation, devices of this type will drive the limb between preset flexion and extension limits. Several techniques for selecting the extension and flexion limits are known and used in the prior art. In accordance with one technique, the CPM device will include mechanical stops which limit motion of the CPM device. The stops are manually adjusted to set the extension and flexion limits. A second technique involves the use of switches, such as thumbwheel switches, which are actuated to provide electrical indicia of desired extension and flexion limits.

In the prior art techniques described above, an operator, such as a clinician, will evaluate the patient's condition and make an "educated guess" as to what the proper extension and flexion limit positions should be. The mechanical stops or switches are then set accordingly. These techniques do not take into account the patient's response, or physiological reaction, to the therapy. If after observing the patient it is determined that the preselected limits are incorrect, the operator must readjust the switches or mechanical stops. This procedure is repeated until proper extension and flexion limit positions are established.

There is a continuing need for improved apparatus for setting extension and flexion limit positions in CPM devices. Such an apparatus will preferably permit a clinician to observe the patient while the extension and flexion limit positions are being established. A "live" display apparatus of this type will permit the clinician to observe the physiological effects of the CPM therapy on the patient, thereby permitting a more accurate setting of extension and flexion limit positions. A device of this type would clearly be far more convenient to use than those of the prior art.

SUMMARY OF THE INVENTION

The present invention is a live display apparatus for selectively setting limits of movement in a continuous passive motion (CPM) system. The CPM system includes carriage means for supporting a patient's limb through a range of reciprocal angular movement, drive means for driving the carriage means through the range of movement, carriage state sensor means for providing a signal representative of a state of the carriage means within the range of movement, and control means responsive to the carriage state sensor means for controlling the drive means. The live display apparatus includes operator controlled first limit select means operatively coupled to the control means for causing the carriage means to be driven through its range of movement to a first selected limit of movement, when actuated during a first limit select mode. The live display apparatus permits a clinician to observe the physiological effects of the CPM therapy while setting limits of movement, thereby permitting more accurate settings. The live display apparatus is also very convenient to use.

In a preferred embodiment, the first limit select means comprises an extension limit select switching having an OFF position, and first and second ON positions. The extension limit switch is biased to its OFF position, and causes the carriage means to be driven through its range of movement to positions of increasing extension when actuated to the first ON position. The extension limit switch causes the carriage means to be driven through its range of movement in a direction of decreasing extension when actuated to the second ON position. Display means continuously provide a visual indication of carriage state when the extension select switch is actuated during the first limit select mode.

In yet another preferred embodiment, the live display apparatus includes operator controlled second limit select means operatively coupled to the control means for causing the carriage means to be driven through its range of movement to a second selected limit of movement, when actuated during a second limit select mode. The second limit select means is preferably a flexion limit select switch biased to an OFF position, and having first and second ON positions. When actuated to the first ON position during the flexion limit select mode, the flexion limit select switch causes the carriage means to be driven through its range of movement to decreasing positions of flexion. When actuated to the second ON position, the flexion limit select switch causes the carriage means to be driven through its range of movement to positions of increasing flexion. Flexion limit display means continuously provide a visual indication of carriage state when the flexion limit select switch is actuated during the flexion limit select mode.

DETAILED DESCRIPTION OF THE PREFERRED EMBODIMENTS

Figure 1:
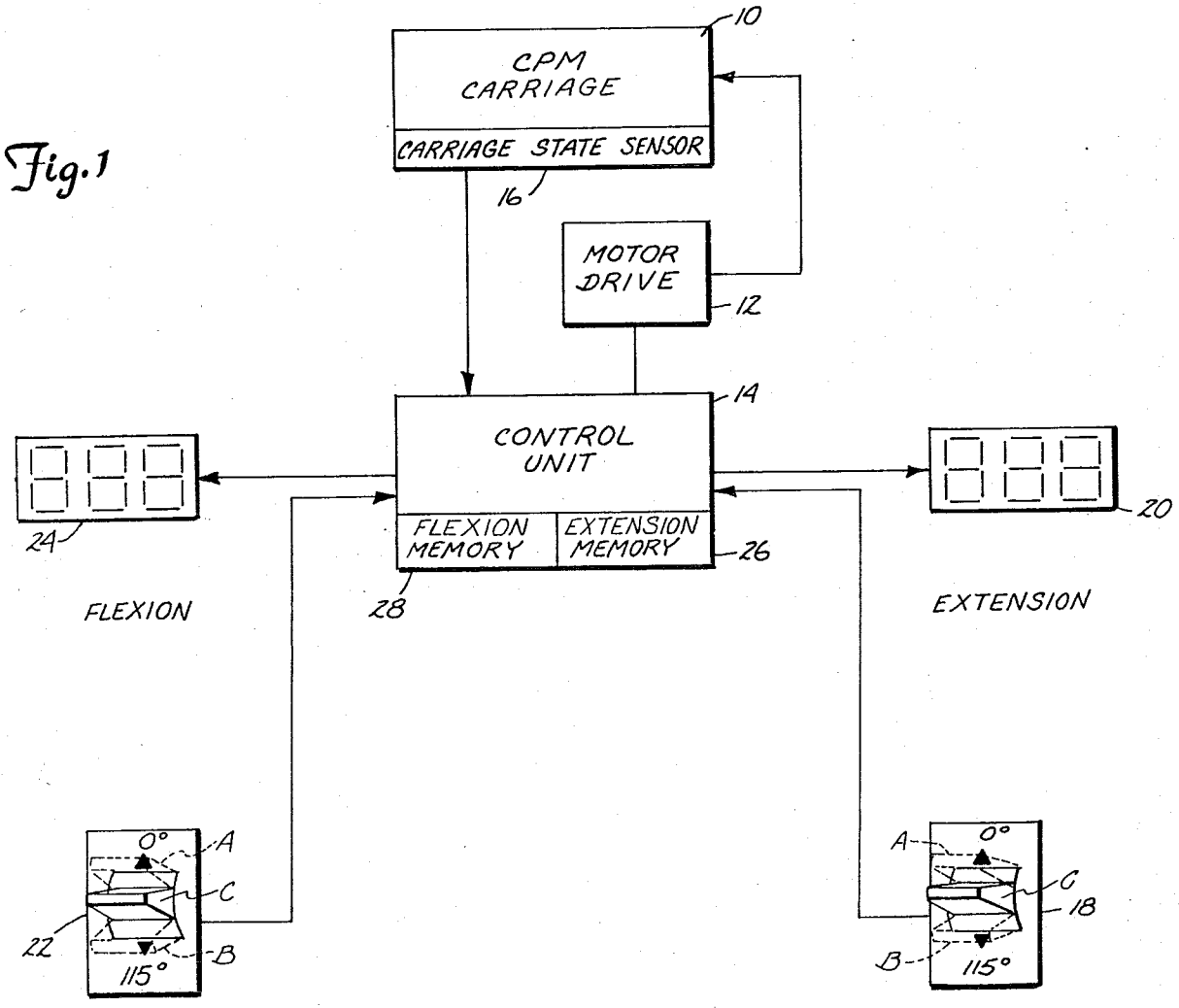
FIG. 1 is a block diagram representation of a continuous passive motion (CPM) system which includes the live display apparatus of the present invention.

The block diagram show in in FIG. 1 illustrates a continuous passive motion (CPM) system which includes the "live display" apparatus of the present invention. CPM systems such as that shown in FIG. 1 includes a carriage 10, drive motor 12, control unit 14 and carriage state sensor 16. CPM carriage 10 supports a patient's limb (such as a leg) through a range of reciprocal angular movement during CPM therapy. Drive motor 12 drives carriage 10 through its range of movement, and is under the control of control unit 14. Carriage state sensor 16 provides signals representative of the state or position of carriage 10 within its range of angular movement to control unit 14.

Figure 2:
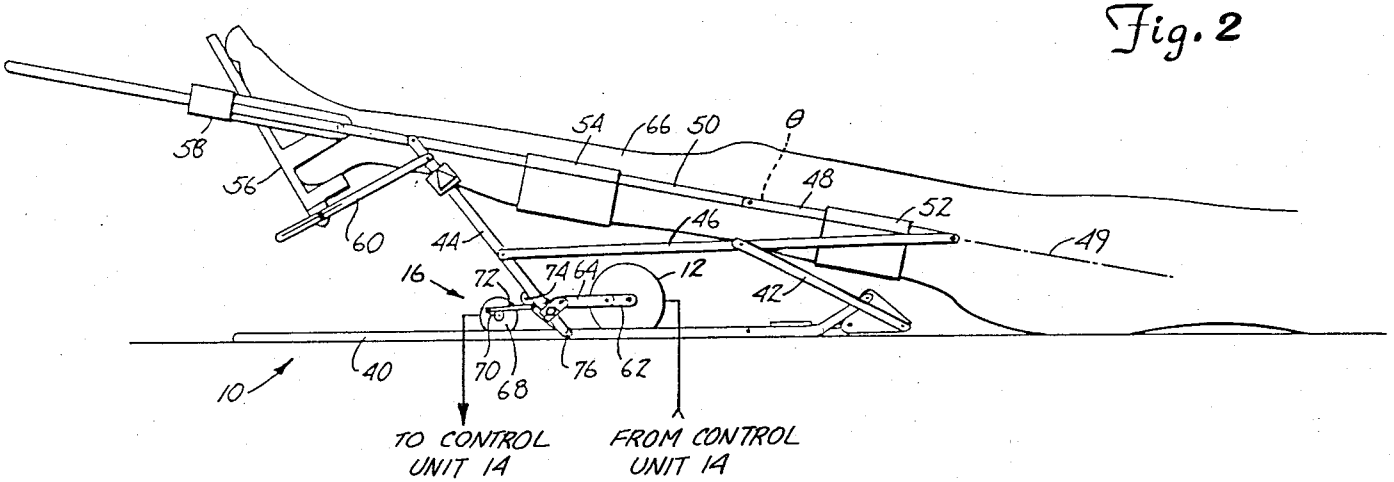
FIG. 2 illustrates the CPM carriage driving a patient's leg to a position of extension.
Figure 3:
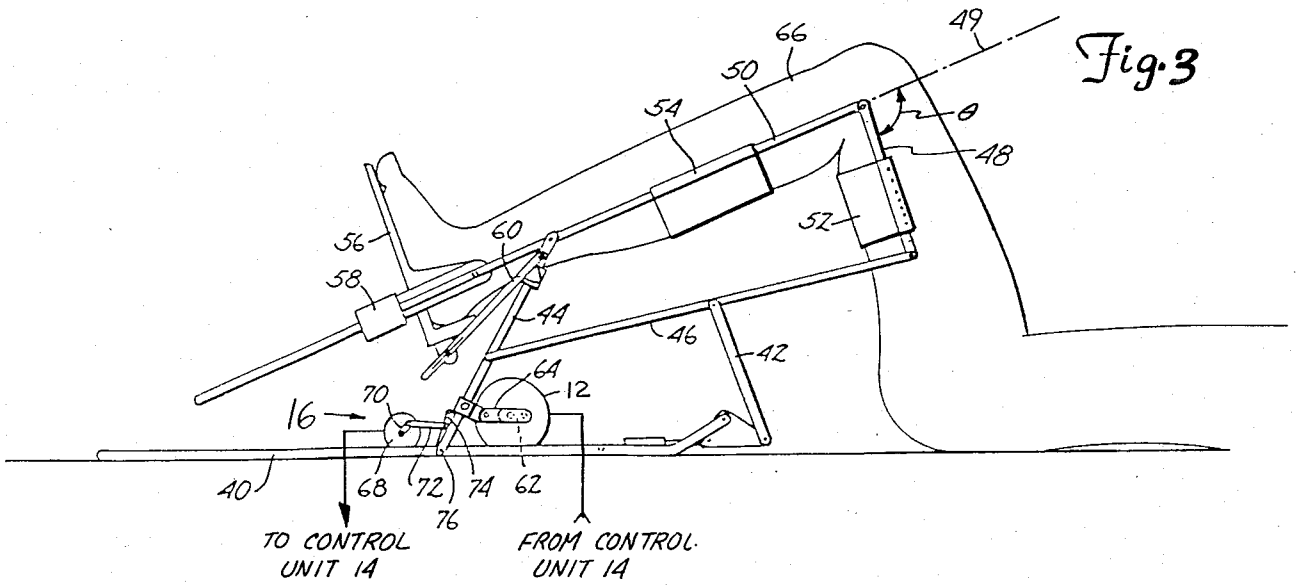
FIG. 3 illustrates the CPM carriage driving a patient's leg to a position of flexion.

During a CPM therapy mode operation, control unit 14 controls drive motor 12 in such a manner as to cause CPM carriage 10 to move the patient's limb in a reciprocal fashion between a first or extension limit position, and a second or flexion limit position. The extension limit position is the position at which the angle between two parts of the limb, such as the femur and tibia of a leg, is at a maximum, as shown in FIG. 2 for example. The flexion limit position is the position at which the angle between the two parts of the limb is at a minimum, as shown in FIG. 3 for example.

The present invention is a "live display" apparatus in that extension and flexion limit positions are established, or set, while the patient's limb is being moved by carriage 10. A clinician can, therefore, monitor the physiological effects of various carriage positions on the patient, and set the limits accordingly.

Referring back to FIG. 1, a preferred embodiment of the live dislay apparatus is shown to include extension limit select switch 18, extension limit display 20, flexion limit select switch 22, and flexion limit display 24. Control unit 14 also includes extension limit memory 26 and flexion limit memory 28. Extension limit select switch 18 is actuated to enter an extension limit select mode, and to select a desired extension limit of movement. Similarly, flexion limit select switch 22 is actuated to enter a flexion limit select mode, and to select a desired flexion limit of movement. An extension limit position is thereby selected during an extension limit select mode, while the flexion limit is selected during a flexion limit select mode. Displays 20 and 24 provide a visual indication of the extension and flexion limits selected during the extension and flexion limit select modes, respectively. Memories 26 and 28 store data representative of the selected extension and flexion limit positions, respectively.

In the embodiment shown in FIG. 1, limit select switches 18 and 22 are three position switches which have a first ON position, illustrated in phantom at A, a second ON position illustrated in phantom at B, and an OFF position C. Limit select switches 18 and 22 are biased so as to return to their OFF position when they are not actuated during the limit select modes. The extension limit select mode and flexion limit select mode are entered whenever switches 20 and 24, respectively, are actuated from their OFF position C. As shown, limit displays 20 and 24 are preferably digital displays which provide a digital indication of selected extension and flexion limits, respectively. Memories 26 and 28 can be of any commonly available read/write type.

The live display apparatus of the present invention is applicable to a wide variety of different CPM carriages. FIGS. 2 and 3 are used to illustrate operation of the present invention with an embodiment of CPM carriage 10 which is described in further detail in a patent application entitled "ORTHOSIS FOR LEG MOVEMENT WITH VIRTUAL HIP PIVOT" by John M. Berner, Ser. No. 578,731 and assigned to the same assignee as the present application.

In the embodiment shown in FIGS. 2 and 3, CPM carriage 10 includes frame 40, a pair of parallel rearward support links 42, a pair of parallel forward support lines 44, a pair of parallel drag links 46, a pair of parallel femur support members 48, a pair of parallel tibia support members 50, a thigh support saddle 52, calf support saddle 54, foot support 56, connector 58, and connecting link 60. Links 42, 44 and 46 and support members 48 and 50 form a double four-bar linkage which transmits the drive power supplied from drive motor 12 through crank 62 and link 64 to cause reciprocal movement of leg 66 between an extension limit position shown in FIG. 2, and a flexion limit position shown in FIG. 3.

In the embodiment shown in FIGS. 2 and 3, carriage state sensor 16 comprises potentiometer 68 which is connected through links 70 and 72 to arm 74. The carriage state signal produced by potentiometer 68 is an analog voltage signal which is proportional to the angular position of arm 74. Forward support links 44 are pivotably connected to frame 40 by pivot shaft 76. Arm 74 is also fixedly connected to pivot shaft 76, so that the angular position of arm 74 follows the angular position of forward support links 44. As a result, the analog carriage state signal has a magnitude which is representative of the position of CPM carriage 10 within its range of movement.

According to a convention used throughout the remainder of this description, carriage state is described by the angle 0 between femur support members 48 and an axis 49 defined by tibia support members 50. In accordance with this convention, positions of extension are represented by a relatively low carriage state, as illustrated in FIG. 2. In the preferred embodiment shown in FIG. 3, carriage 10 has a state of 0° in its maximum or peak extension position. Positions of flexion, on the other hand, are represented by higher carriage state. A carriage state of approximately 90° is illustrated in FIG. 3. In a preferred embodiment, carriage 10 can be driven to a maximum or peak flexion state of 115°.

Operation of the live display apparatus of the present invention is best described with reference to FIGS. 1–3. Extension limit positions are selected by a clinician during an extension limit select mode by actuating extension limit select switch 18 in the following manner. When switch 18 is actuated to first ON position A, control unit 14 will cause carriage 10 to be driven in a first direction of increasing extension, or toward lower carriage states. When switch 18 is actuated to second ON position B, control unit 14 will cause carriage 10 to be driven in a second direction toward positions of decreasing extension, or higher carriage state. In either case, the then current position or state of carriage 10 (as indicated by the signal from carriage state sensor 16) will be the selected extension limit when switch 18 is returned to its OFF position C. Data representative of this selected extension position is stored in extension memory 26. Extension display 20 will provide a visual display indicative of the carriage state at all times when extension limit select switch 18 is being actuated during the extension limit select mode.

A flexion limit is selected by a clinician in a similar manner using flexion limit select switch 22 during a flexion limit select mode. When switch 22 is actuated to first ON position A, control unit 14 causes carriage 10 to be driven in a first direction toward decreasing positions of flexion, and lower carriage state. When switch 22 is actuated to second ON position B, control unit 14 causes carriage 10 to be driven in a second direction toward increasing positions of flexion, and higher carriage state. The then current position or state of carriage 10 will be the selected flexion limit when switch 22 is returned to OFF position C. Data representative of the flexion limit position selected in this manner is stored in flexion memory 28. Flexion display 24 will continuously provide a visual display indicative of the state of carriage 10 while switch 22 is actuated during the flexion limit select mode.

During its normal operating mode (i.e. during CPM therapy), control unit 14 causes carriage 10 to be reciprocally driven between extension and flexion limit positions selected during the extension and flexion limit select modes. Control unit 14 will, for example, cause carriage 10 to be driven in a direction of increasing flexion and carriage state. When carriage state sensor 16 produces a signal representative of the selected flexion limit, as stored in flexion memory 28, control unit 16 changes the direction of rotation of drive motor 12, so as to reverse the direction of angular movement and thereby drive carriage 10 in a direction of increasing extension and lower carriage state. When carriage state sensor 16 produces a signal representative of the selected extension limit, as stored in memory 26, control unit 14 again changes the direction of rotation of drive motor 18, and causes carriage 10 to again be driven toward a direction of increasing flexion.

Through use of the live display apparatus described above, a clinician can observe the patient as the limb is driven to extension and flexion limit positions. In this manner, extension and flexion limits can be selected based upon physiological criteria observed from the patient. By watching the patient's response during flexion and extension limit select modes, the extension and flexion limits can more accurately be set for a specific patient's physiological criteria. Extension display 20 and flexion display 24 serve primarily a record keeping function by indicating the selected limit positions. Relative comparisons between patients, and an indication of a patient's progress over time, can thereby be made.

Although the present invention has been described with reference to preferred embodiments, workers skilled in the art will recognize that changes may be made in form and detail without departing from the spirit and scope of the invention.

What is claimed is:

1. A live display apparatus for selectively setting limits of movement in a continuous passive motion (CPM) system, including:

CPM carriage means for supporting a patient's limb through a range of reciprocal angular movement;

drive means for driving the carriage means through the range of reciprocal angular movement;

carriage state sensor means for providing a signal representative of a state of the carriage means within the range of reciprocal angular movement;

first limit memory means for storing data;

first limit select switch means having OFF and first ON positions; and control means coupled to the carriage state sensor means, first limit memory means and the first limit select switch means, for controlling the drive means, wherein the control means causes the carriage means to be operated in a first limit select mode and driven through its range of movement in a first direction to a first selected limit of movement while the first limit select switch means is in its first ON position, causes data representative of the state of the carriage at the first selected limit of movement to be stored in the first limit memory means when the first limit select switch means is switched from the first ON position to the OFF position, and causes the carriage means to be operated in a normal operating mode and driven as a function of the signal provided by the carriage state sensor means and the data stored in the first limit memory means when the first limit select switch means is in its OFF position.

2. The apparatus of claim 1 wherein the control means causes the first limit of movement to be an extension limit.

3. The apparatus of claim 1 wherein the first limit select switch means has a second ON position, and wherein the control means causes the carriage means to be operated in the first limit select mode and driven through its range of movement in a second direction to a first selected limit of movement while the first limit select switch means is in its second ON position, and causes data representative of the state of the carriage at the first selected limit of movement to be stored in the first limit memory means when the first limit select switch means is switched from the second ON position to the OFF position.

4. The apparatus of claim 3 wherein the control means causes the first direction to be a direction of increasing extension, and the second direction to be a direction of decreasing extension.

5. The apparatus of claim 3 wherein the first limit select switch means is normally biased to its OFF position.

6. The apparatus of claim 1 and further including first limit display means responsive to the control means for providing a visual display indicative of the first selected limit of movement selected during the first limit select mode.

7. The apparatus of claim 6 wherein the first limit display means comprises a digital display.

8. The apparatus of claim 6 wherein the first limit display means provides a continuous visual display indicative of the carriage state as the first limit select switch means is actuated during the first limit select mode.

9. The apparatus of claim 1 and further including: second limit memory means for storing data; and second limit select switch means having OFF and first ON positions, wherein the control means causes the carriage means to be operated in a second limit select mode and driven through its range of movement in a first direction to a second selected limit of movement while the second limit select switch means is in its first ON position, causes data representative of the state of the carriage at the second selected limit of movement to be stored in the second limit memory means when the second limit select switch means is switched from the first ON position to the OFF position, and causes the carriage means to be operated in a normal operating mode and driven as a function of the signal provided by the carriage stage sensor means and the data stored in the first and second limit memory means when the first and second limit select switch means are in their OFF positions.

10. The apparatus of claim 9 wherein the control means causes the second limit of movement to be a flexion limit.

11. The apparatus of claim 9 wherein the second limit select switch means has a second ON position, and wherein the control means causes the carriage means to be operated in the second limit select mode and driven through its range of movement in a second direction to a second selected limit of movement while the second limit select switch means is in its second ON position, and causes data representative of the state of the carriage means at the second selected limit of movement to be stored in the second limit memory means when the second limit select switch means is switched from the second ON position to the OFF position.

12. The apparatus of claim 11 wherein the control means causes the first direction to be a direction of decreasing flexion, and the second direction to be a direction of increasing flexion.

13. The apparatus of claim 11 wherein the second limit select switch is normally biased to its OFF position.

14. The apparatus of claim 9 and further including second limit display means responsive to the control means for providing a visual display indicative of the second limit of movement selected during the second limit select mode.

15. The apparatus of claim 14 wherein the second display means comprises a digital display.

16. The apparatus of claim 15 wherein the second display means provides a continuous visual display indicative of the carriage state as the second limit select switch means is actuated during the second limit select mode.

17. A live display apparatus for setting extension and flexion limits of movement in a continuous passive motion (CPM) system, including:

CPM carriage means for supporting a patient's limb through a range of reciprocal angular movement;

drive means for driving the carriage means through the range of reciprocal angular movement;

carriage state sensor means for providing a signal representative of a state of the carriage means within the range of reciprocal angular movement;

memory means for storing data;

operator controlled extension limit select switch means having an OFF and first and second ON positions;

operator controlled flexion limit select switch means having an OFF and first and second ON positions;

control means coupled to the carriage state sensor means, the memory means, the extension limit select switch means, and the flexion limit select switch means, for controlling the drive means, wherein:

the control means causes the carriage means to be operated in an extension limit select mode and driven through its range of movement, beginning in a direction of increasing extension, to a selected extension limit of movement while the extension limit select switch means is in its first ON position;

the control means causes the carriage means to be operated in the extension limit select mode and driven through its range of movement, beginning in a direction of decreasing extension, to a selected extension limit of movement while the extension limit switch means is in its second ON position;

the control means causes data representative of the state of the carriage means at the selected extension limit of movement to be stored in the memory means when the extension limit select switch means is switched from the first or second ON positions to the OFF position;

the control means causes the carriage means to be operated in a flexion limit select mode and driven through its range of movement, beginning in a direction of increasing flexion, to a selected flexion limit of movement while the flexion limit select switch means is in its first ON position;

the control means causes the carriage means to be operated in the flexion limit select mode and driven through its range of movement, beginning in a direction of decreasing flexion, to a selected flexion limit of movement while the flexion limit select switch means is in its second ON position;

the control means causes data representative of the state of the carriage means at the selected flexion limit of movement to be stored in the memory means when the flexion limit select switch means is switched from the first or second ON positions to the OFF position; and the control means causes the carriage means to be operated in a normal operating mode and driven as a function of the signal provided by the carriage state sensor means and the data stored in the memory means when the extension and flexion limit select switch means are in their OFF positions;

extension limit display means responsive to the control means for providing a visual display indicative of the extension limit selected during the extension limit select mode; and flexion limit display means responsive to the control means for providing a visual display indicative of the flexion limit selected during the flexion limit select mode.

18. The apparatus of claim 17 wherein the extension limit select switch means and the flexion limit select switch means are normally biased to the OFF positions.

19. The apparatus of claim 17 wherein the extension limit display means continuously provides a visual display indicative of the carriage state when the extension limit select switch means is actuated during the extension limit select mode.

20. The apparatus of claim 17 wherein the extension limit display means comprises a digital display.

21. The apparatus of claim 17 wherein the flexion limit display means provides a continuous visual display indicative of the carriage state as the flexion limit select switch means is actuated in the flexion limit select mode.

22. The apparatus of claim 17 wherein the flexion limit display means comprises a digital display.

* * * * *

UNITED STATES PATENT AND TRADEMARK OFFICE

CERTIFICATE OF CORRECTION

PATENT NO. : 4,807,601

DATED : February 28, 1989

INVENTOR(S) : Thomas C. Wright

It is certified that error appears in the above-identified patent and that said Letters Patent is hereby corrected as shown below:

In the Title, line 1, delete "APPARTUS" and insert "APPARATUS".

In the Title, line 2, delete "EXTENSON" and insert "EXTENSION".

Signed and Sealed this

Twenty-second Day of August, 1989

*Attest:*

*Attesting Officer*

DONALD J. QUIGG

*Commissioner of Patents and Trademarks*